US008011401B1

(12) United States Patent
Utterback

(10) Patent No.: US 8,011,401 B1
(45) Date of Patent: Sep. 6, 2011

(54) TOILET BOWL PROTECTING METHOD AND ASSEMBLY

(76) Inventor: David K. Utterback, New Hampton, IA (US)

( * ) Notice: Subject to any disclaimer, the term of this patent is extended or adjusted under 35 U.S.C. 154(b) by 41 days.

(21) Appl. No.: 12/549,476

(22) Filed: Aug. 28, 2009

(51) Int. Cl.
*B65D 5/02* (2006.01)
*A47K 17/00* (2006.01)

(52) U.S. Cl. ..... 150/154; 4/253; 4/661; 4/901

(58) Field of Classification Search ..... 150/154; 4/253, 300, 661, 901
See application file for complete search history.

(56) References Cited

U.S. PATENT DOCUMENTS

| | | | | | |
|---|---|---|---|---|---|
| 1,763,277 | A | * | 6/1930 | Tilden | 4/242.1 |
| 2,652,874 | A | * | 9/1953 | Armstrong | 4/661 |
| 2,652,875 | A | * | 9/1953 | Puste | 4/661 |
| 2,658,201 | A | * | 11/1953 | Sherwood | 4/661 |
| 2,709,468 | A | * | 5/1955 | Macrae et al. | 4/251.2 |
| 3,085,611 | A | * | 4/1963 | Dolnick | 4/661 |
| D217,248 | S | * | 4/1970 | Basner | D23/313 |
| 3,524,203 | A | * | 8/1970 | Ruggles | 4/661 |
| 3,566,414 | A | * | 3/1971 | Basner | 4/661 |
| 3,935,890 | A | | 2/1976 | Dolnick | |
| 5,027,493 | A | | 7/1991 | Wood, Jr. et al. | |
| 5,067,185 | A | | 11/1991 | Kohler | |
| 5,073,998 | A | | 12/1991 | Wood, Jr. et al. | |
| D370,724 | S | | 6/1996 | Elsey | |
| 5,560,049 | A | * | 10/1996 | Robinson et al. | 4/253 |
| 5,581,824 | A | | 12/1996 | Crook, Sr. | |
| 5,974,597 | A | | 11/1999 | Conwell | |
| 6,108,827 | A | | 8/2000 | Espadas | |
| D439,315 | S | * | 3/2001 | Valentin | D23/311 |
| 6,718,565 | B1 | | 4/2004 | Cruz | |
| D503,970 | S | * | 4/2005 | Johnson | D23/311 |
| 2002/0112280 | A1 | * | 8/2002 | Christmas | 4/242.1 |
| 2004/0172743 | A1 | | 9/2004 | Crerar | |

* cited by examiner

*Primary Examiner* — Sue Weaver

(57) ABSTRACT

A toilet bowl protecting assembly includes a flexible toilet bowl covering with a top wall having a front edge, a pair of lateral edges and a rear edge. A vertical wall is attached to and extends downwardly from the top wall. The vertical wall is attached to and is coextensive with each of the front and lateral edges. The top wall is positioned on top of a toilet lid and seat of the toilet and the vertical wall extending downwardly over a toilet bowl of the toilet. A flexible tank covering including an upper wall and a perimeter wall is attached to and extending downwardly from the upper wall, the tank covering is positionable on and covering a tank of the toilet.

7 Claims, 4 Drawing Sheets

TOILET BOWL PROTECTING METHOD AND ASSEMBLY

BACKGROUND OF THE DISCLOSURE

Field of the Disclosure

The disclosure relates to toilet bowl protecting devices and more particularly pertains to a new toilet bowl protecting device for covering and protecting a toilet so that work on a dwelling wall, floor or ceiling adjacent to the toilet does not mar, stain or otherwise blemish the toilet with dust or finishing materials.

SUMMARY OF THE DISCLOSURE

An embodiment of the disclosure meets the needs presented above by generally comprising a flexible toilet bowl covering that includes a top wall having a front edge, a pair of lateral edges and a rear edge. A vertical wall is attached to and extends downwardly from the top wall. The vertical wall is attached to and is coextensive with each of the front and lateral edges. The top wall is positioned on top of a toilet lid and seat of the toilet and the vertical wall extending downwardly over a toilet bowl of the toilet. A flexible tank covering including an upper wall and a perimeter wall is attached to and extending downwardly from the upper wall, the tank covering is positionable on and covering a tank of the toilet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
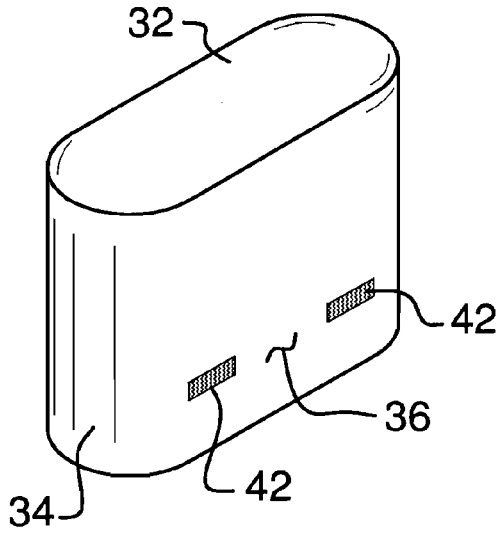
FIG. 2 is a rear perspective view of a tank covering of an embodiment of the disclosure.
Figure 1:
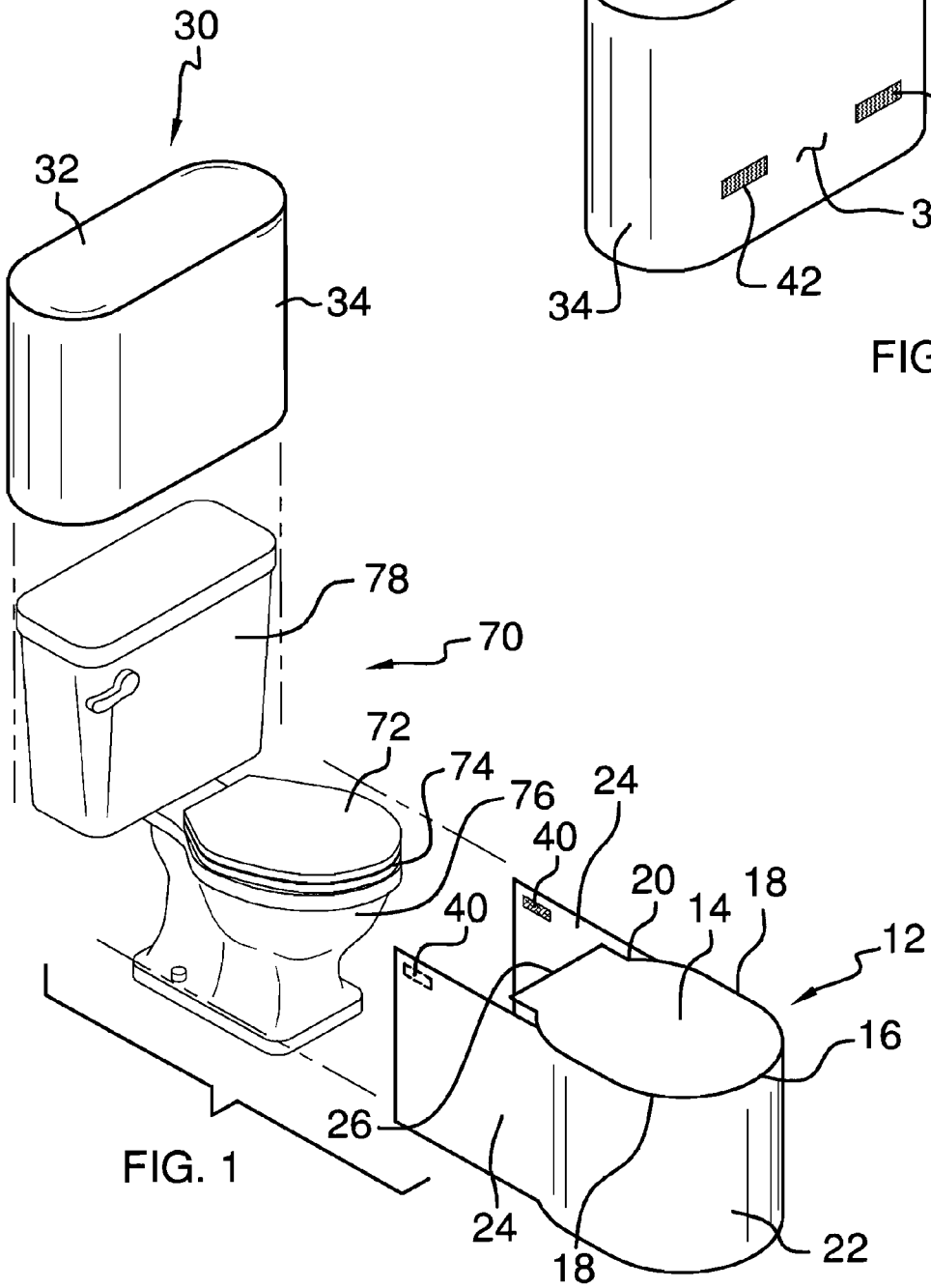
FIG. 1 is an exploded top perspective view of a toilet bowl protecting method and assembly according to an embodiment of the disclosure.
Figure 3:
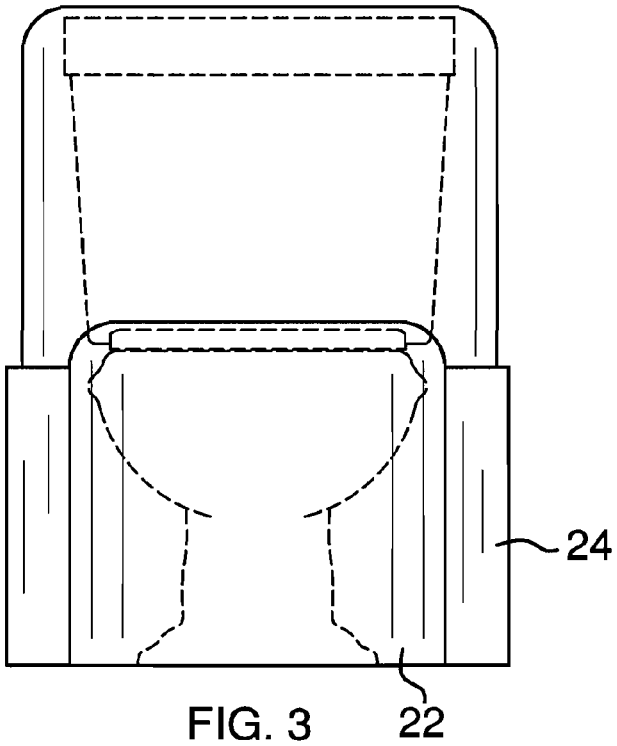
FIG. 3 is a front view of an embodiment of the disclosure.
Figure 4:
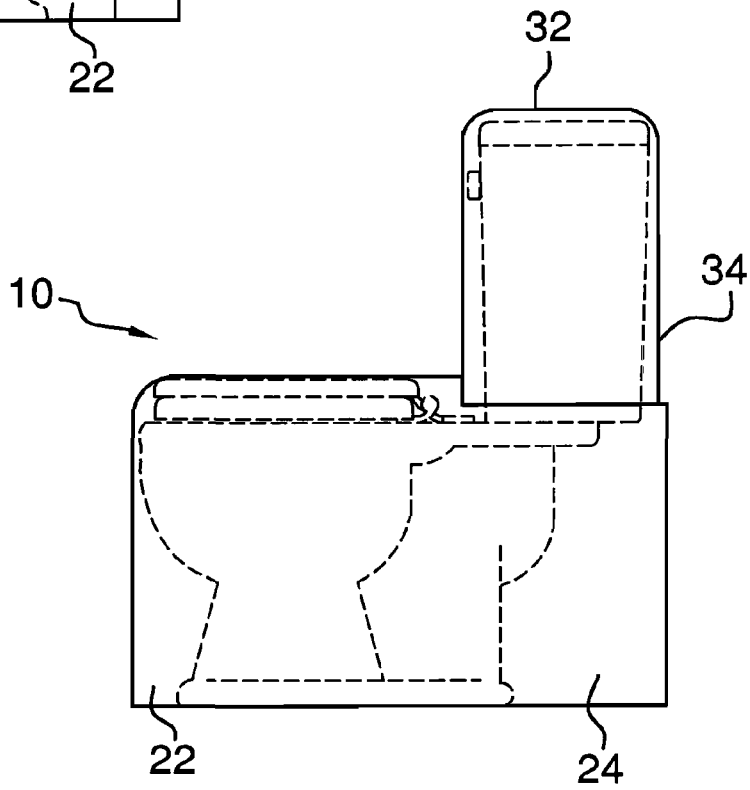
FIG. 4 is a side view of an embodiment of the disclosure.

With reference now to the drawings, and in particular to FIGS. 1 through 5 thereof, a new toilet bowl protecting device embodying the principles and concepts of an embodiment of the disclosure and generally designated by the reference numeral 10 will be described.

As best illustrated in FIGS. 1 through 5, the toilet bowl protecting method and assembly 10 generally comprises a flexible toilet bowl covering 12 that includes a top wall 14 having a front edge 16, a pair of lateral edges 18 and a rear edge 20. A vertical wall 22 is attached to and extends downwardly from the top wall 14. The vertical wall 22 is attached to and is coextensive with each of the front 16 and lateral 18 edges. The top wall 14 is positioned on top of a toilet lid 72 and seat 74 of a toilet 70 and the vertical wall 22 extends downwardly over a toilet bowl 76 of the toilet 70. The vertical wall 22 includes a pair of lateral flaps 24 extending rearward of the rear edge 20. A top flap 26 is attached to and extends away from the rear edge 20. The top flap 26 is unattached to the lateral flaps 24 and is positionable on a connection between a tank 78 and the toilet bowl 76 of the toilet 70.

A flexible tank covering 30 includes an upper wall 32 and a perimeter wall 34 that is attached to and extends downwardly from the upper wall 32. The tank covering 30 is positionable on and covers the tank 78 of the toilet 70. The toilet bowl 12 and tank 30 coverings are each comprised of a flexible material such as a plastic or paper material. Further, the material may be impermeable or resistant to fluids.

A plurality of couplers releasably couple the lateral flaps 24 to the tank covering 30. The couplers include first mating members 40 attached to the lateral flaps 24 and second mating members 42 coupled to the perimeter wall 34. The couplers may include hook and loop fasteners. The second mating members 42 may be positioned on a back wall 36 of the tank covering 30 to allow the lateral flaps 24 to be extended partially around the toilet tank 78 and shield the back side of the toilet bowl 76.

Figure 5:
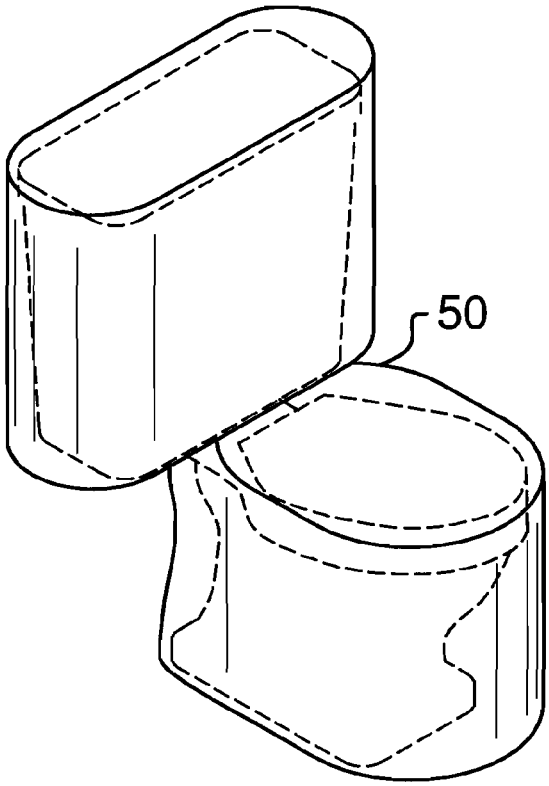
FIG. 5 is a top perspective view of an embodiment of the disclosure.
Figure 6:
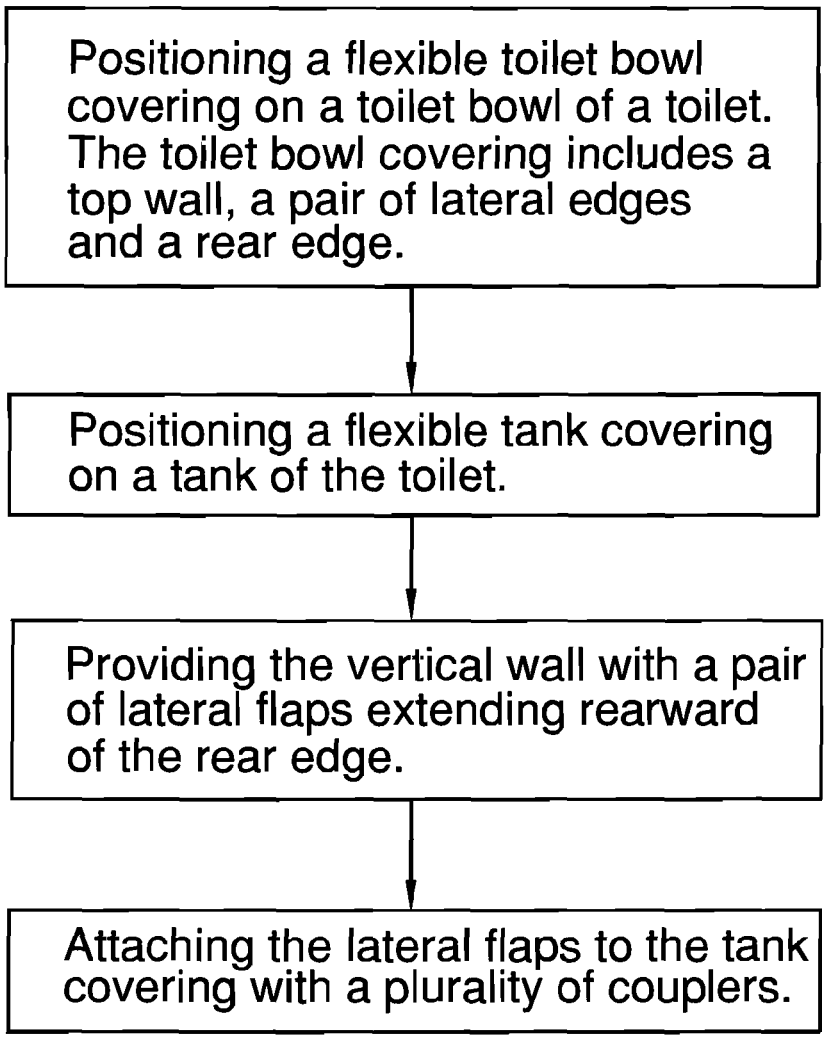
FIG. 6 is a schematic view of an embodiment of the disclosure.

Another embodiment of the invention is found in FIG. 5. This embodiment includes a one-piece covering 50 having the tank and bowl coverings fixedly coupled together.

In use, the assembly 10 is placed on a toilet as described above so that work adjacent to the toilet 70 may be performed without material, such as paint, dust and plaster type materials or any other elements used adjacent to the toilet 70 while repairing, fixing or finishing floors, walls and ceiling adjacent to the toilet 70. The assembly 10 will ensure that the toilet 70 remains unmarred from these activities.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A toilet covering assembly being positionable on a toilet to completely cover the toilet, said assembly including:

a flexible toilet bowl covering including a top wall having a front edge, a pair of lateral edges and a rear edge, a vertical wall being attached to and extending downwardly from said top wall, said vertical wall being attached to and being coextensive with each of said front and lateral edges, said top wall being configured to be positioned on top of a toilet lid and seat of the toilet and said vertical wall being configured to extend downwardly over a toilet bowl of the toilet to completely cover an entire vertical height of a front side and a pair of lateral sides of the toilet bowl from a lowest most edge of the toilet bowl to the top of the toilet lid; and a flexible tank covering including an upper wall and a perimeter wall being attached to and extending downwardly from said upper wall, said tank covering being positionable on and covering a tank of the toilet, said perimeter wall being free of any apertures from said upper wall to a bottom edge of said perimeter wall.

2. The assembly according to claim 1, wherein said vertical wall includes a pair of lateral flaps extending rearward of said rear edge.

3. The assembly according to claim 2, further including a top flap being attached to and extending away from said rear edge, said top flap being unattached to said lateral flaps.

4. The assembly according to claim 2, further including a plurality of couplers releasably coupling said lateral flaps to said tank covering, said couplers including first mating members attached to said lateral flaps and second mating members coupled to said perimeter wall.

5. A toilet covering assembly being positionable on a toilet to completely cover the toilet, said assembly including:

a flexible toilet bowl covering including a top wall having a front edge, a pair of lateral edges and a rear edge, a vertical wall being attached to and extending downwardly from said top wall, said vertical wall being attached to and being coextensive with each of said front and lateral edges, said top wall being positioned on top of a toilet lid and seat of the toilet and said vertical wall extending downwardly over a toilet bowl of the toilet, said vertical wall including a pair of lateral flaps extending rearward of said rear edge, a top flap being attached to and extending away from said rear edge, said top flap being unattached to said lateral flaps;

a flexible tank covering including an upper wall and a perimeter wall being attached to and extending downwardly from said upper wall, said tank covering being positionable on and covering a tank of the toilet; and a plurality of couplers releasably coupling said lateral flaps to said tank covering, said couplers including first mating members attached to said lateral flaps and second mating members coupled to said perimeter wall.

6. A method of protecting a toilet from material falling on the toilet, said method comprising the steps of:

positioning a flexible toilet bowl covering on a toilet bowl of the toilet, said toilet bowl covering including a top wall having a front edge, a pair of lateral edges and a rear edge, a vertical wall being attached to and extending downwardly from said top wall, said vertical wall being attached to and being coextensive with each of said front and lateral edges, said top wall being positioned on top of a toilet lid and seat of the toilet and said vertical wall extending downwardly over the toilet bowl of the toilet to completely cover an entire vertical height of a front side and a pair of lateral sides of the toilet bowl from a lowest most edge of the toilet bowl to the top of the toilet lid; and positioning a flexible tank covering on a tank of the toilet, said tank covering including an upper wall and a perimeter wall being attached to and extending downwardly from said upper wall, said tank covering being positionable on and covering the tank of the toilet, said perimeter wall being free of any apertures from said upper wall to a bottom edge of said perimeter wall.

7. The method according to claim 6, further including the steps of:

providing said vertical wall with a pair of lateral flaps extending rearward of said rear edge; and attaching said lateral flaps to said tank covering with a plurality of couplers.

* * * * *